US008086431B2

(12) United States Patent
Caldera

(10) Patent No.: US 8,086,431 B2
(45) Date of Patent: Dec. 27, 2011

(54) METHOD AND SYSTEM FOR INTERPRETING SWABBING TESTS USING NONLINEAR REGRESSION

(75) Inventor: Jose A. Caldera, Provincia del Chubut (AR)

(73) Assignee: Schlumberger Technology Corporation, Sugar Land, TX (US)

( * ) Notice: Subject to any disclaimer, the term of this patent is extended or adjusted under 35 U.S.C. 154(b) by 424 days.

(21) Appl. No.: 12/236,442

(22) Filed: Sep. 23, 2008

(65) Prior Publication Data

US 2009/0084544 A1 Apr. 2, 2009

Related U.S. Application Data

(60) Provisional application No. 60/976,383, filed on Sep. 28, 2007.

(51) Int. Cl.
*G06F 9/455* (2006.01)

(52) U.S. Cl. ..... 703/10

(58) Field of Classification Search ..... 703/10; 166/250.07, 302; 702/13, 6; 73/152.41, 73/152.46; 175/25
See application file for complete search history.

(56) References Cited

U.S. PATENT DOCUMENTS 5,573,064 A * 11/1996 Hisaw ..... 166/250.07
5,974,874 A * 11/1999 Saulsberry ..... 73/152.41
6,148,912 A * 11/2000 Ward ..... 166/250.07
6,189,612 B1 * 2/2001 Ward ..... 166/250.07
6,220,087 B1 * 4/2001 Hache et al. ..... 73/152.46
6,273,202 B1 8/2001 Zamfes
6,575,242 B2 6/2003 Woie
6,672,386 B2 1/2004 Krueger et al.
6,842,700 B2 * 1/2005 Poe ..... 702/13
7,086,464 B2 8/2006 Edwards et al.
2002/0011333 A1 * 1/2002 Ward ..... 166/250.07
2003/0139916 A1 * 7/2003 Choe et al. ..... 703/10
2007/0162235 A1 * 7/2007 Zhan et al. ..... 702/6
2007/0284107 A1 * 12/2007 Crichlow ..... 166/302
2008/0060846 A1 * 3/2008 Belcher et al. ..... 175/25

OTHER PUBLICATIONS

Al-awad, M., "Prediction of critical pipe running speed during tripping in drilling operations", Journal of King Saud University, 1999.*
Kuchuk, at al. "Analysis of simulataneously measured pressure and sandface flow rate in transient well testing", Society of Petroleum Engineers, 1985.*
Poe et al., "Advanced fractured well diagnostics for production data analysis", Society of Petroleum Engineers, 1999.*
Kuchuk, F., "A new method for determination of reservoir pressure", Society of Petroleum Engineers, 1999.*
Vella et al., "Nuts and bolts of well testing", Oilfield Review 1992.*
Smolen et al., "Formation evaluation using wireline formation tester pressure data", Society of Petroleum Engineers, 1979.*
Prat et al., "A new approach to evaluate layer productivity before well completion", Society of Petroleum Engineers, 1999.*

(Continued)

*Primary Examiner* — Kandasamy Thangavelu

(57) ABSTRACT

A method for increasing production in a reservoir, comprising performing a swabbing test at a depth in a pipe, wherein the pipe is located in a wellbore and wherein a portion of the wellbore is located inside the reservoir, periodically measuring, during the swabbing test, pressure in the bottom portion of the pipe using the pressure gauge to obtain a plurality of pressure measurements, wherein the pressure gauge is affixed to an inner wall of a bottom portion of the pipe, and determining a plurality of flow rates of fluid flowing from the reservoir through perforations in the wellbore into the pipe using a flow rate equation and the plurality of pressure measurements.

20 Claims, 8 Drawing Sheets

OTHER PUBLICATIONS

Lester et al., "Ram/Powell tension leg platform: horizontal well design and operational experience", Offshore technology conference, 1999.*

Mustafa Onur, SPE, Instanbul Technical University, and Fikri J. Kuchuk, SPE, Schlumberger Oilfield Services; Integrated Nonlinear Regression Analysis of Multiprobe Wireline Formation Tester Packer and Probe Pressures and Flow Rate Measurements; Society of Petroleum Engineers Inc., SPE 56616; Oct. 1999; 14 pages.

Pascal, H., "Discussion of analysis of simultaneously measured pressure and sandface flow rate in transient well testing"; Journal of Petroleum Technology, Mar. 1985, pp. 545-548.

Kucuk, F. et al.; "Authors' reply to discussion of analysis of simultaneously measured pressure and sandface flow rate in transient well testing"; Journal of Petroleum Technology, Oct. 1985; pp. 1867-1869.

* cited by examiner

METHOD AND SYSTEM FOR INTERPRETING SWABBING TESTS USING NONLINEAR REGRESSION

CROSS-REFERENCES TO RELATED APPLICATIONS

This application claims priority pursuant to 35 U.S.C. §119 (e) to U.S. Provisional Patent Application No. 60/976,383 entitled "Swabbing Test Interpretation Using Nonlinear Regression," filed Sep. 28, 2007 in the name of Jose A. Caldera, the entire contents of which is incorporated herein by reference.

BACKGROUND

There are typically three main phases that are undertaken to obtain hydrocarbons from a given field of development or on a per well basis. The phases are exploration, appraisal and production. During exploration one or more subterranean volumes (i.e., reservoirs) are identified that may include fluids in an economic quantity.

Following successful exploration, the appraisal phase is conducted. During the appraisal phase, operations, such as drilling wells, are performed to determine the size of the oil or gas field and how to develop the oil or gas field. After the appraisal phase is complete, the production phase is initiated. During the production phase fluids are produced from the oil or gas field.

More specifically, the production phase involves producing fluids from a reservoir. A wellbore is created by a drilling operation, and the wellbore perforates the reservoir. Once the drilling operation is complete and the wellbore is formed, completion equipment is installed in the wellbore, which is reinforced with a casing for purposes of production. The casing is perforated at a depth corresponding with the reservoir, and the fluids in the reservoir are allowed to flow from the reservoir to surface production facilities. At the end of the drilling operation, an analysis is conducted to determine the potential to produce hydrocarbons from the reservoir. One factor in determining the potential to produce hydrocarbons from a reservoir is permeability.

In various parts of the world, the swabbing test is the conventional technique used by companies to induce fluid to flow from the reservoir into the wellbore in reservoirs in which this does not naturally occur. When swabbing tests are used in a wellbore, conventional methods for analyzing pressure measurements taken in the wellbore, including but not limited to semilog slope, log-log horizontal line, convolution algorithms, and conventional transient pressure analysis, may not be used because the fluid flow rate over the duration of the swabbing test is not constant.

SUMMARY

In general, in one aspect, the invention relates to a method for increasing production in a reservoir. The method includes performing a swabbing test at a depth in a pipe, wherein the pipe is located in a wellbore and wherein a portion of the wellbore is located inside the reservoir, periodically measuring, during the swabbing test, pressure in the bottom portion of the pipe using the pressure gauge to obtain a plurality of pressure measurements, wherein the pressure gauge is affixed to an inner wall of a bottom portion of the pipe, and determining a plurality of flow rates of fluid flowing from the reservoir through perforations in the wellbore into the pipe using a flow rate equation and the plurality of pressure measurements.

In general, in one aspect, the invention relates to a computer readable medium, embodying instructions executable by a computer to perform a method, the instructions including functionality to perform a swabbing test at a depth in a pipe, wherein the pipe is located in a wellbore and wherein a portion of the wellbore is located inside the reservoir, periodically measure, during the swabbing test, pressure in the bottom portion of the pipe using the pressure gauge to obtain a plurality of pressure measurements, wherein the pressure gauge is affixed to an inner wall of a bottom portion of the pipe, determine a plurality of flow rates of fluid flowing from the reservoir through perforations in the wellbore into the pipe using a flow rate equation and the plurality of pressure measurements, and generate a model of the reservoir using the plurality of flow rates of fluid, wherein the model is used to determine a production potential of the reservoir.

In general, in one aspect, the invention relates to a computer readable medium, embodying instructions executable by a computer to perform a method, the instructions including functionality to perform a swabbing test at a depth in a pipe, wherein the pipe is located in the wellbore, periodically measure, during the swabbing test, pressure in the bottom portion of the pipe using the pressure gauge to obtain a plurality of pressure measurements, wherein the pressure gauge is affixed to an inner wall of a bottom portion of the pipe, determine a plurality of flow rates of fluid flowing from the reservoir through perforations in the wellbore into the pipe using a flow rate equation and the plurality of pressure measurements, determine a permeability of the reservoir using a nonlinear regression model and the plurality of flow rates, and determine an operation to perform, using the permeability, to increase the production of hydrocarbons in the reservoir, wherein the operation comprises at least one from a group consisting of drilling an additional wellbore, drilling a lateral in the wellbore, fracturing the formation, and installing and operating production equipment.

Other aspects of the invention will be apparent from the following description and the appended claims.

DETAILED DESCRIPTION

Figure 1:
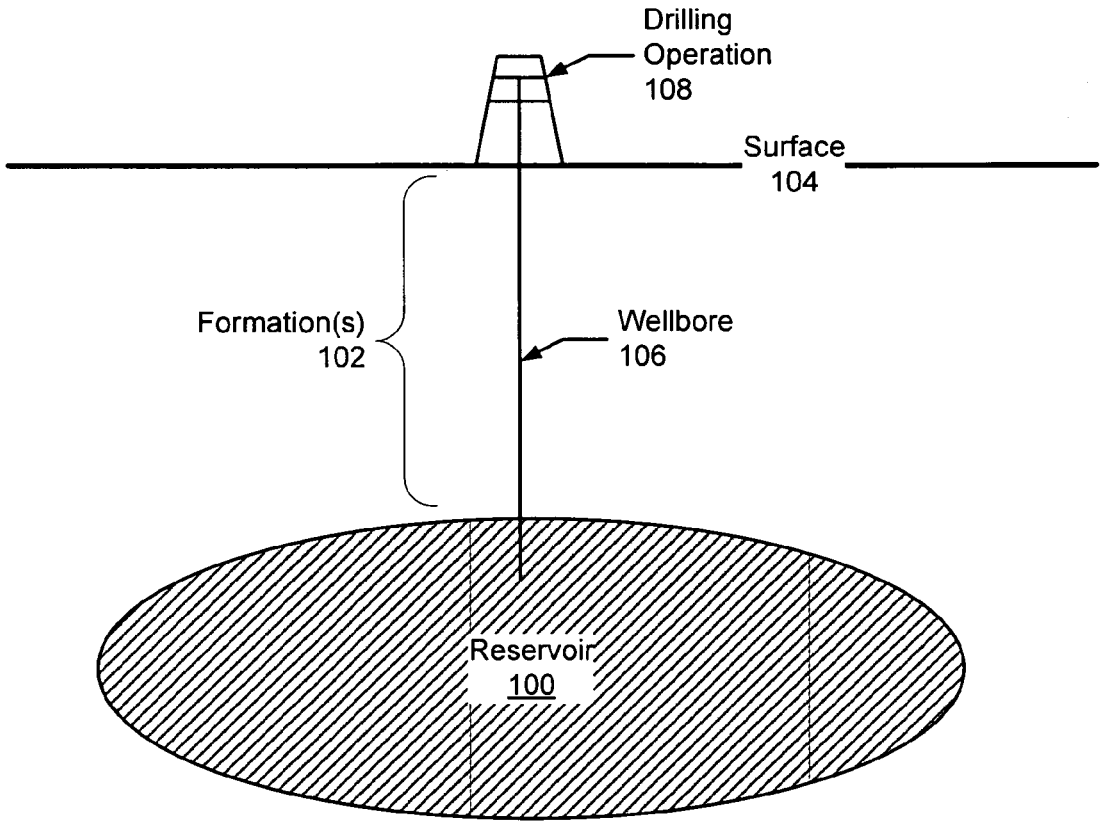
FIG. 1 depicts production of a reservoir in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention relate to a method and system for calculating the permeability of a well and improving forecasts for the production of hydrocarbons from a reservoir. More specifically, embodiments of the invention relate to a method and system of determining flow rate of a fluid from a reservoir during a swabbing test. In addition, embodiments of the invention relate to a cost-effective and efficient method and system, using nonlinear regression models, to determine the permeability of a well that has undergone a swabbing test.

Figure 3:
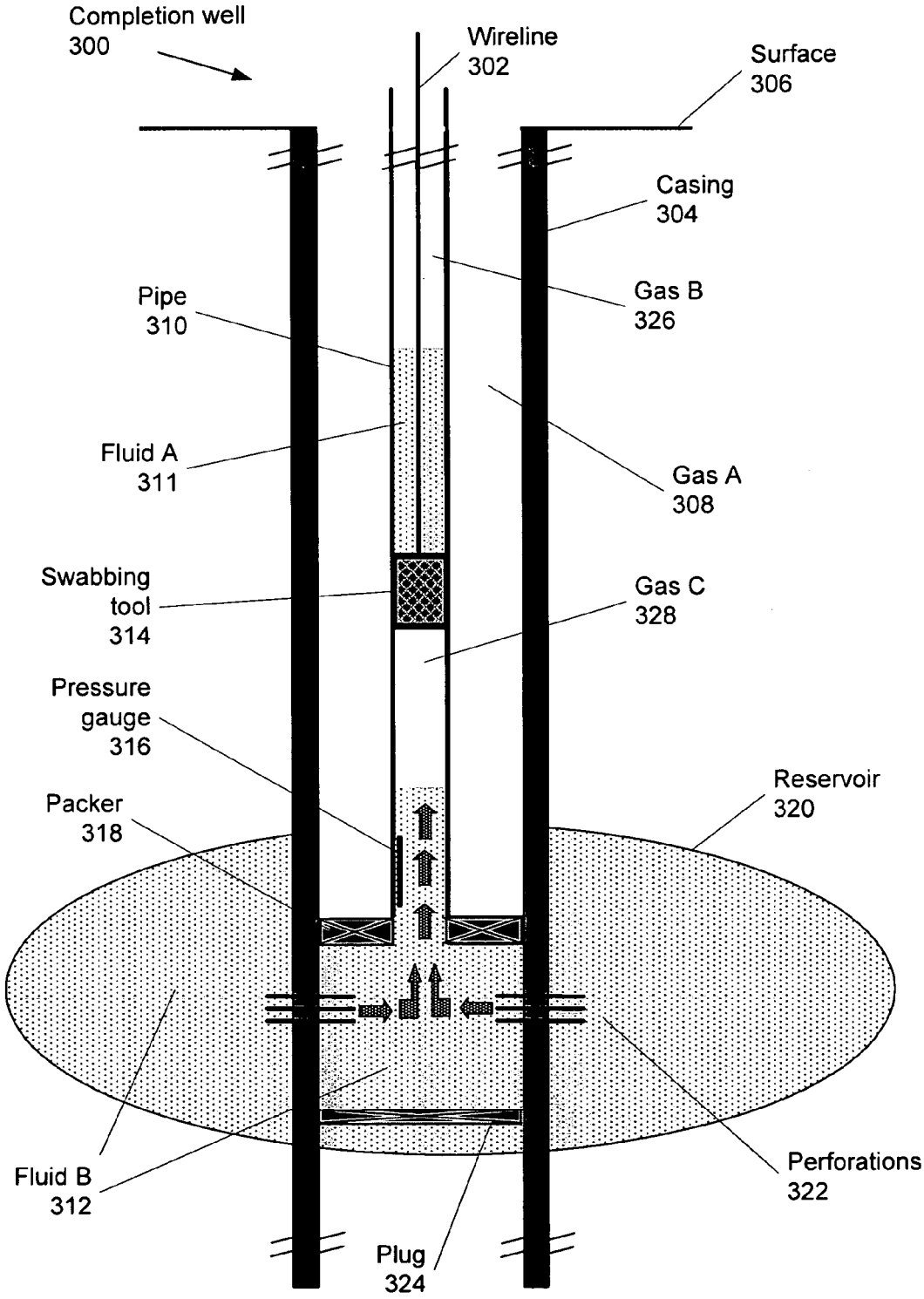
FIG. 3 depicts a swabbing test in accordance with one or more embodiments of the invention.

As depicted in FIG. 1, fluids are produced from a reservoir (100). The reservoir (100) is accessed by drilling a wellbore (106) through one or more formations (102) where the wellbore (106) intersects with the reservoir (100). The wellbore (106) is created by a drilling operation (108). A swabbing test, as shown in FIG. 3 and described below, may be conducted to evaluate the production potential of the reservoir (100) during completion of the well, at which time the wellbore (106) is reinforced with a casing, often a large diameter pipe reinforced with cement.

Figure 2:
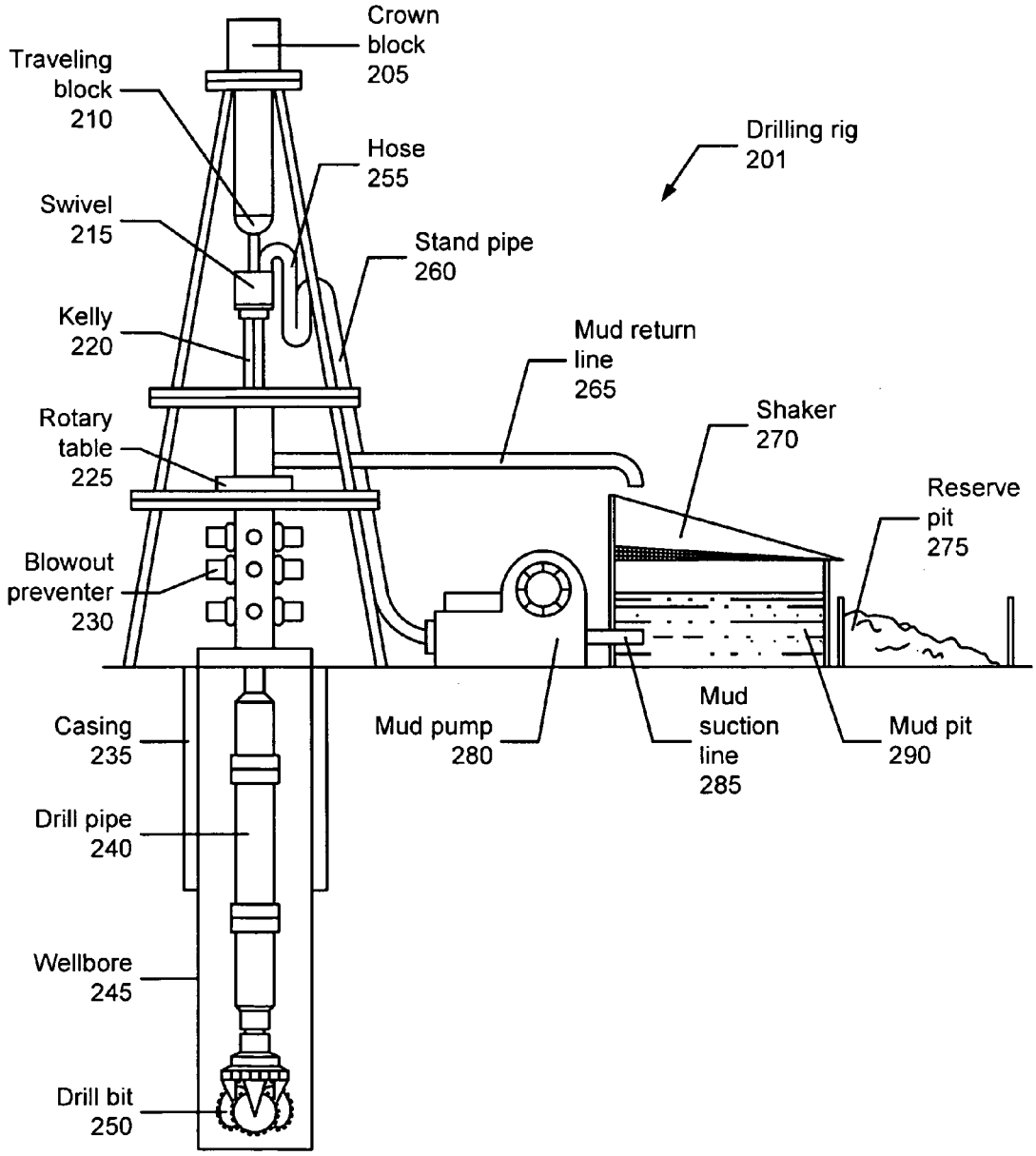
FIG. 2 depicts a drilling operation in accordance with one or more embodiments of the invention.

FIG. 2 depicts a diagram of a drilling operation, in which a drilling rig (201) is used to turn a drill bit (250) coupled at the distal end of a drill pipe (240) in a wellbore (245). The drilling operation may be used to provide access to reservoirs containing fluids, such as oil, natural gas, water, or any other type of material obtainable through drilling. Although the drilling operation shown in FIG. 2 is for drilling directly into an earth formation from the surface of land, those skilled in the art will appreciate that other types of drilling operations also exist, such as lake drilling or deep sea drilling.

As depicted in FIG. 2, rotational power generated by a rotary table (225) is transmitted from the drilling rig (201) to the drill bit (250) via the drill pipe (240). Further, drilling fluid (also referred to as "mud") is transmitted through the drill pipe's (240) hollow core to the drill bit (250) and up the annulus (252) of the drill pipe (240), carrying away cuttings (portions of the earth cut by the drill bit (250)). Specifically, a mud pump (280) is used to transmit the mud through a stand pipe (260), hose (255), and kelly (220) into the drill pipe (240). To reduce the possibility of a blowout, a blowout preventer (230) may be used to control fluid pressure within the wellbore (245). Further, the wellbore (245) may be reinforced using one or more casings (235), to prevent collapse due to a blowout or other forces operating on the borehole (245). The drilling rig (201) may also include a crown block (205), traveling block (210), swivel (215), and other components not shown.

Mud returning to the surface from the borehole (245) is directed to mud treatment equipment via a mud return line (265). For example, the mud may be directed to a shaker (270) configured to remove drilled solids from the mud. The removed solids are transferred to a reserve pit (275), while the mud is deposited in a mud pit (290). The mud pump (280) pumps the filtered mud from the mud pit (290) via a mud suction line (285), and re-injects the filtered mud into the drilling rig (201). Those skilled in the art will appreciate that other mud treatment devices may also be used, such as a degasser, desander, desilter, centrifuge, and mixing hopper. Further, the drilling operation may include other types of drilling components used for tasks such as fluid engineering, drilling simulation, pressure control, wellbore cleanup, and waste management.

During completion operations, equipment is installed in the well to isolate different formations and to direct fluids, such as oil, gas or condensate, to the surface. Completion equipment may include equipment to prevent sand from entering the wellbore or to help lift the fluids to the surface if the reservoir's inherent or augmented pressure is insufficient. The wellbore is often reinforced with a casing, usually a large diameter pipe reinforced with cement. A swabbing test is an example of an operation that is performed when the well is completed.

FIG. 3 shows a swabbing test in accordance with one or more embodiments of the invention. A swabbing test for a completion well (300) typically includes: (i) a wireline (302); (ii) a swabbing tool (314); (iii) a pipe (310); (iv) casing (304); (v) a pressure gauge (316); (vi) a packer (318); (vii) a plug (324); (viii) fluid (e.g., fluid A (311) and/or fluid B (312)); (ix) perforations (322); (x) a reservoir (320); and (xi) gas (e.g., gas A (308), gas B (326), gas C (328)). Each of these components is described below.

As shown in FIG. 3, a section of the completion well is isolated by use of a plug (324) to seal the bottom portion of the isolated area and a packer (318) to seal the top portion of the isolated area. The plug (324) is a solid piece that fits completely against the entire circumference of the inner wall of the casing (304). The packer (318), unlike the plug (324), includes some sort of a hole (often circular) through its center. The pipe (310) is orientated such that it is aligned with the hole in the packer (318). In one or more embodiments of the invention, a pressure gauge (316) is placed on the inner wall of the pipe near the bottom portion of the pipe. In one or more embodiments of the invention, the pressure gauge is affixed to the inner wall of the pipe using techniques well known in the art. Further, the location of the pressure gauge (316) relative to the end of the pipe (310) may vary depending on the implementation. In one or more embodiments of the invention, the location of the pressure gauge (316) is located on the inner wall of the pipe such that it does not come into contact with the swabbing tool (314).

In one or more embodiments of the invention, before the swabbing test begins, the swabbing tool (314) is lowered toward the bottom of the pipe (310) and comes to rest at a location inside the pipe (310), just above the pressure gauge (316). A portion of the swabbing tool (314) is configured to expand to approximately the diameter of the inner wall of the pipe (310) while traveling in one direction. Specifically, the swabbing tool (314) is oriented to lift the fluid (e.g., fluid A (311)) located above the swabbing tool (314) up the pipe (310) toward the surface (306). The swabbing tool (314) may include a check valve (not shown), which allows fluid to flow through the swabbing tool (314) as the swabbing tool (314) is lowered in the pipe (310). In this example, some fluid (e.g., fluid A (311)) is forced up the pipe (310) above the swabbing tool (314) as the swabbing tool (314) is lowered into position at the bottom portion of the pipe (316). Those skilled in the art will appreciate that other fluid may include, but is not limited to, completion fluid, reservoir fluid (e.g., hydrocarbons, etc), other fluid, or any combination thereof.

As the swabbing test run starts, the swabbing tool (314) is pulled toward the surface (306) by the wireline (302). The wireline (302) is connected to a device (not shown) on the surface, e.g., a winch, to enable the wireline (302) to be raised and lowered at a controlled rate. As discussed above, as the swabbing tool (314) is pulled toward the surface (306) and the fluid (e.g., fluid A (311)) is lifted up the pipe (310), which lowers the pressure toward the bottom of the pipe (310). As the pressure toward the bottom of the pipe (310) decreases, the pressure against the reservoir (320) also decreases, allowing the fluid (e.g., fluid B (312)) in the reservoir (320) to enter the casing (304). As the fluid (e.g., fluid B (312)) in the reservoir (320) enters the casing (304), the pressure toward the bottom of the pipe (310) increase, increases the pressure read by the pressure gauge (316). In one or more embodiments of the invention, the fluid (e.g., fluid B (312)) flows from the reservoir (320), through the perforations (322) into the casing (304).

In certain situations, a pocket of gas (gas C (328)), which may include but is not limited to air, may occupy space between the under side of the swabbing tool (314) and the fluid (e.g., fluid B (312)) in the pipe (310) as the swabbing tool (314) is lifted toward the surface (306). Another pocket of gas (gas A (308)), which may be the same gas as the pocket of gas (gas C (328)), may occupy space between the inner wall of the casing (304) and the outer wall of the pipe (310) above the packer (318). In addition, another pocket of gas (gas B (326)) may occupy space above the fluid (e.g., fluid B (312)) being pushed to the surface (306) by the swabbing tool (314) inside the pipe (310). In all locations that a pocket of gas (e.g., gas A (308), gas B (326), gas C (328)) occupies, the gas (e.g., gas A (308), gas B (326), gas C (328)) may be naturally occurring in the environment, or the gas (e.g., gas A (308), gas B (326), gas C (328)) may be a specific type of gas that is injected into that location.

Continuing with the discussion of FIG. 3, as the swabbing tool (314) approaches the surface (306), more fluid (e.g., fluid A (311)) enters the pipe (310) behind the swabbing tool (314), and this increase in fluid (e.g., fluid A (311) and/or fluid B (312)) increases the pressure being read by the pressure gauge (316). Once the swabbing tool (314) reaches the surface, fluid (e.g., fluid A (311) and/or fluid B (312)) that was drawn upward is collected and may be subsequently analyzed. Additional swabbing tests may be conducted, either at the same depth in the completion well (300) or at a different depth in the completion well (300). Further, each swabbing test may have multiple runs. In one or more embodiments of the invention, if the swabbing test is performed at different depths, the depth of the plug (324) and packer (318) within the pipe may be adjusted and additional perforations created in the appropriate locations prior to initiating additional swabbing tests.

Figure 4:
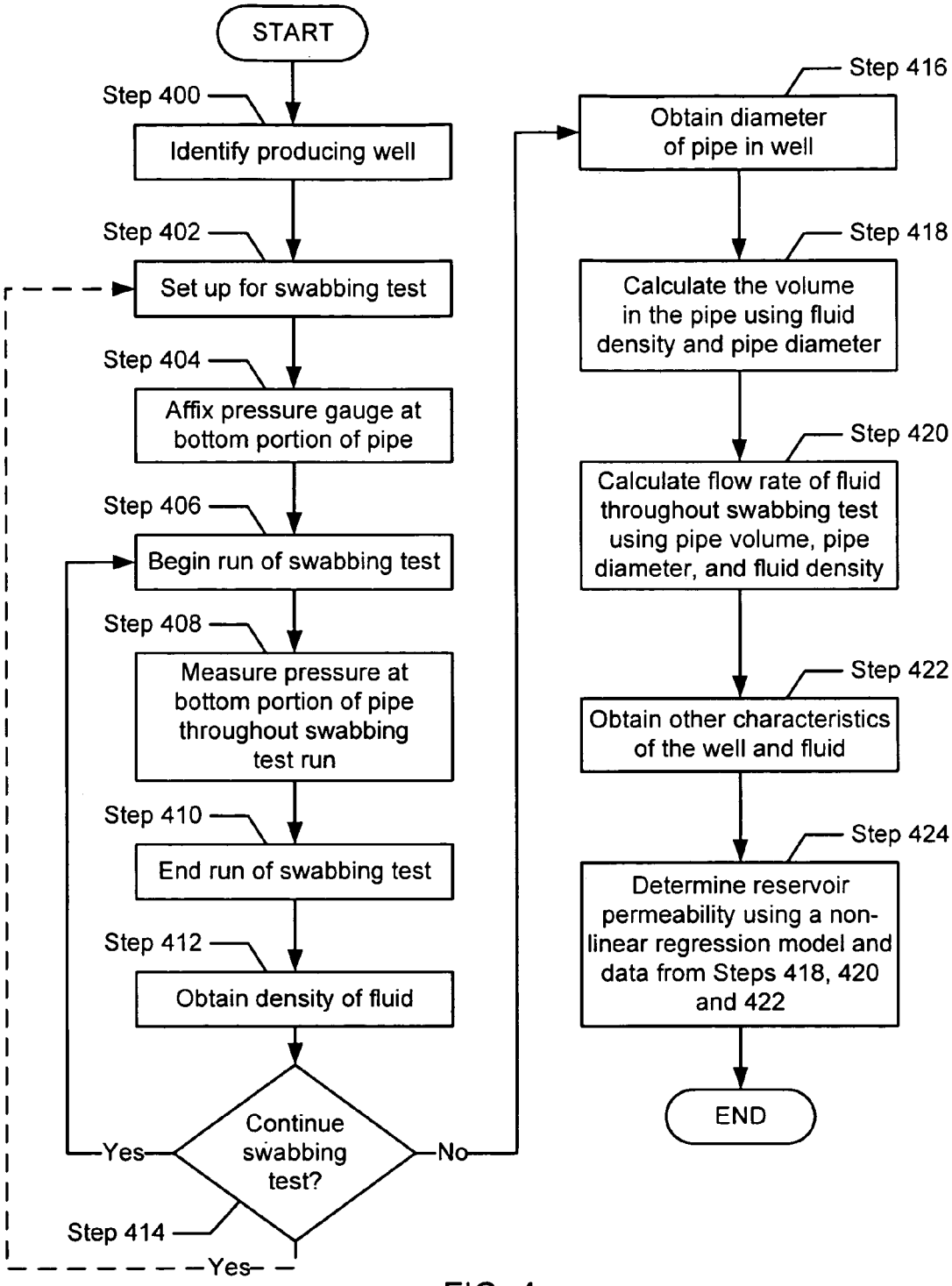
FIG. 4 depicts a flowchart for interpreting a swabbing test in accordance with one or more embodiments of the invention.

FIG. 4 depicts a flowchart for interpreting a swabbing test in accordance with one or more embodiments of the invention. While the various steps in this flowchart are presented and described sequentially, one of ordinary skill will appreciate that some or all of the steps may be executed in different orders, may be combined or omitted, and some or all of the steps may be executed in parallel. In addition, a person of ordinary skill in the art will appreciate that other steps, omitted in FIG. 4, may be included in one or more embodiment of this flowchart. Accordingly, the specific arrangement of steps shown in FIG. 4 should not be construed as limiting the scope of the invention.

In Step 400, a production well is identified. In one or more embodiments of the invention, the production well is not producing the expected level of hydrocarbons. The determination as to what the expected levels should be for a producing well is typically made in advance of production, and the expected levels of production may be modified at times before or during production. The basis of the determination may vary according to a number of factors including, but not limited to: hydrocarbon resource, permeability, conductivity, seismic analysis, and logging analysis. One with skill in the art will appreciate that swabbing tests may be conducted in circumstances not related to an underperforming well. Accordingly, other embodiments of the invention may apply to these other circumstances as well.

In Step 402, the swabbing equipment (see e.g., FIG. 3) is placed inside the casing. In Step 404, a pressure gauge is placed toward the bottom of the pipe on the inside wall of the pipe. In one or more embodiments of the invention, the pressure gauge is affixed to the inside wall of the pipe above and adjacent to the packer. In another embodiment of the invention, the pressure gauge is integrated into the pipe. In such cases, the pressure gauge may already be present in the well prior to Step 402. In one or more embodiments of the invention, the pressure gauge may be of a variety of makes, models, and manufacturers. Further, the pressure gauge is selected such that it is able to withstand the harsh and turbulent environment, both in terms of pressure and flow rate of the fluid, that exists at the bottom of the pipe during the swabbing test. Moreover, the pressure gauge for a given swabbing test is selected such that it also accurately reads a wide range of pressures, as may be experienced at the bottom of the pipe during the swabbing test.

In one or more embodiments of the invention, the pressure gauge includes functionality to: (i) continuously obtain pressure readings for the duration of the swabbing test to the surface and convey such readings in real-time or near real-time and/or (ii) continuously obtain pressure readings for the duration of the swabbing test and convey (or enable access to) the recorded pressure readings at a point in time after the swabbing test has concluded.

In Step 406, the swabbing tool is lowered to the bottom portion of the pipe to begin a run of the swabbing test. The swabbing tool starts its run toward the bottom portion of the pipe. In one or more embodiments of the invention, the swabbing tool starts its run at some point above the pressure gauge.

In Step 408, the pressure readings are obtained using the pressure gauge. These pressure measurements are obtained throughout the duration of each run of the swabbing test. As the swabbing tool is lifted closer to the surface during the swabbing test run, more fluid fills the pipe underneath the swabbing tool resulting in an increase in the pressure measured by the pressure gauge. The pressure readings may be obtained continuously or in intervals throughout the duration of the swabbing test.

In Step 410, the run of the swabbing test ends. In Step 412, the density of the fluid drawn to the surface during the swabbing test is obtained. Those skilled in the art will appreciate that other data may be measured, calculated, or otherwise obtained from the aforementioned fluid as well. In Step 414, a determination is made as to whether to start another run of the swabbing test. A number of factors may influence this decision including, but not limited to, whether the data obtained during recent runs of the swabbing test are consistent. For example, if the data obtained from the fluid in the prior three runs of the swabbing test are consistent, then there may not be a need to begin an additional run of the swabbing test. Inconsistent data from consecutive runs of the swabbing test in a given well may indicate that the flow rate has not reached a steady state and, accordingly, additional runs of the swabbing test may be required to better understand the characteristics of the reservoir.

In addition to conducting additional swabbing tests at the same depth in the casing or wellbore, swabbing tests may also be conducted at different depths in the casing or wellbore. If swabbing tests are conducted at a different depth, the casing wall or wellbore may need to be perforated at the necessary depths to allow fluid from that part of the reservoir to flow through the casing so that data may be obtained from the fluid after each run of the swabbing test. In one or more embodiments of the invention, swabbing tests may be conducted at different depths within the wellbore in situations where the formation characteristics in which the reservoir is located are non-uniform. If a swabbing test is to be conducted at a different depth, the process proceeds to Step 402. If another run of the swabbing test is to be started at the same depth, the process proceeds to Step 406. If another run of the swabbing test is not to be started, the process proceeds to Step 416.

In Step 416, the diameter of the pipe used for each of the swabbing tests is obtained. In one or more embodiments of the invention, the pipe diameter may be obtained from, for example, the manufacture's specifications of the pipe. Alternatively, the pipe diameter may be directly measured or determined both another method. In Step 418, the volume of the pipe is calculated using, for example, the density of the fluid (e.g., obtained in Step 402), the diameter of the pipe (e.g., obtained in Step 416), and well known formulas within the art.

In Step 420, the flow rate of the fluid for the duration (or portion thereof) for each run of the swabbing test is determined. In one or more embodiments of the invention, flow rate(s) is determined using, for example, the diameter of the pipe (e.g., obtained in Step 416), the density of the fluid (e.g., obtained in Step 412), and the volume in the pipe (e.g., obtained in Step 418).

The following describes two sets of equations that may be used in Step 420. With respect to the first set of equations, Equation (1) provides an estimate of the instantaneous flow rate is calculated based on the following formula:

$$Q(i)=\{[(P(t_i)-P(t_{i-1}))/\text{fluid gradient}]*\text{pipe capacity}\}/(t_i-t_{i-1}) \quad (1)$$

where Q(i) is the estimated instantaneous flow rate at time i, $P(t_i)$ is the instantaneous pressure at time $t_i$ and $P(t_{i-1})$ is the instantaneous pressure at time $t_{i-1}$. The aforementioned pressures may be obtained from the pressure readings recorded in Step 408. Further, the fluid gradient and pipe capacity may be calculated using well known formulas in the art.

With respect to the second set of equations, Equation (2) provides the instantaneous flow rate based on the following formula:

$$Q(i)=[kh(P_i-P_{(i)})]/\{162.6B_o\mu[\log(kt/\Phi\mu c_t r_w^2)-3.23+0.868sJ\} \quad (2)$$

where Q(i) is the instantaneous flow rate at time i, k is the permeability, measured in millidarcy (md), h is the thickness of the reservoir, measured in feet (ft), $P_i$ is the initial pressure, $P_{(i)}$ is the instantaneous pressure at time $t_i$, $B_o$ is the formation volume factor (unitless number), μ is the viscosity, measured in centipoise (cP), t is the time, measured in hours, Φ is porosity in terms of a unitless fraction, $c_t$ is the total compressibility, measured in terms of inverse pounds per square inch ($psi^{-1}$), $r_w$ is the radius of the pipe, measured in feet (ft); and s is the skin, a unitless number.

In one or more embodiments of the invention, Equation (2) may be used to calculate a history of instantaneous flow rates that correspond to a series of pressure changes between two increments of time. In one or more embodiments of the invention, values for k (permeability) and s (skin) are initially assumed while calculating the instantaneous flow rate using Equation (2). The value of Q(i) is subsequently calculated and then used to generate an estimate of $P_{(i)}$ using Equation (3) (see below). The estimate of $P_{(i)}$ is then compared with the measured $P_{(i)}$ (obtained in Step 408). If estimated $P_{(i)}$ is equal to (or within a tolerance range of) measured $P_{(i)}$, then calculation of the value of Q(i) (or an estimate of Q(i) within a tolerance range) is completed. If not, then values of k and s, Q(i) is re-calculated using Equation (2) and verified using Equation (3). The process repeats until estimated $P_{(i)}$ is equal to (or within a tolerance range of) measured $P_{(i)}$.

$$\text{Estimated } P_{(i)}=P_{(i-1)}+\{[Q_{(i)}*(t_{(i)}-t_{(i-1)})/\text{pipe capacity}]*\text{ fluid gradient}\} \quad (3)$$

Continuing with FIG. 4, in Step 422, other characteristics of the well and fluid are obtained for use in Step 424. Examples of such characteristics may include, but are not limited to, temperature, water separation, reservoir height, and porosity.

In Step 424, the permeability of the reservoir is determined using a non-linear regression model. In one or more embodiments of the invention, the non-linear regression model solves for permeability and skin considering several independent variables, which may include, but are not limited to, the instantaneous flow rates from Equation (2), the volume of the pipe, fluid density, pipe diameter, flow rate of the fluid for the duration of the swabbing test, and other well and fluid characteristics such as temperature, pressure, and porosity. In one or more embodiments of the invention, the non-linear regression model may use mathematical formulas designed to determine permeability, given a number of known variables that are related to permeability.

In one or more embodiments of the invention, using the nonlinear regression model may involve establishing initial values for the independent variables and establishing a convergence criteria for the iterative calculative process involved.

In one or more embodiments of the invention, the non-linear regression model used in to determine the reservoir permeability is described in an article entitled, "Integrated Nonlinear Regression Analysis of Multiprobe Wireline Formation Tester Packer and Probe Pressures and Flow Rate Measurements." (Mustafa Onur and Fikri J. Kuchuk, Society of Petroleum Engineers paper 56616, 1999.), which is hereby incorporated by reference in its entirety.

Figure 5:
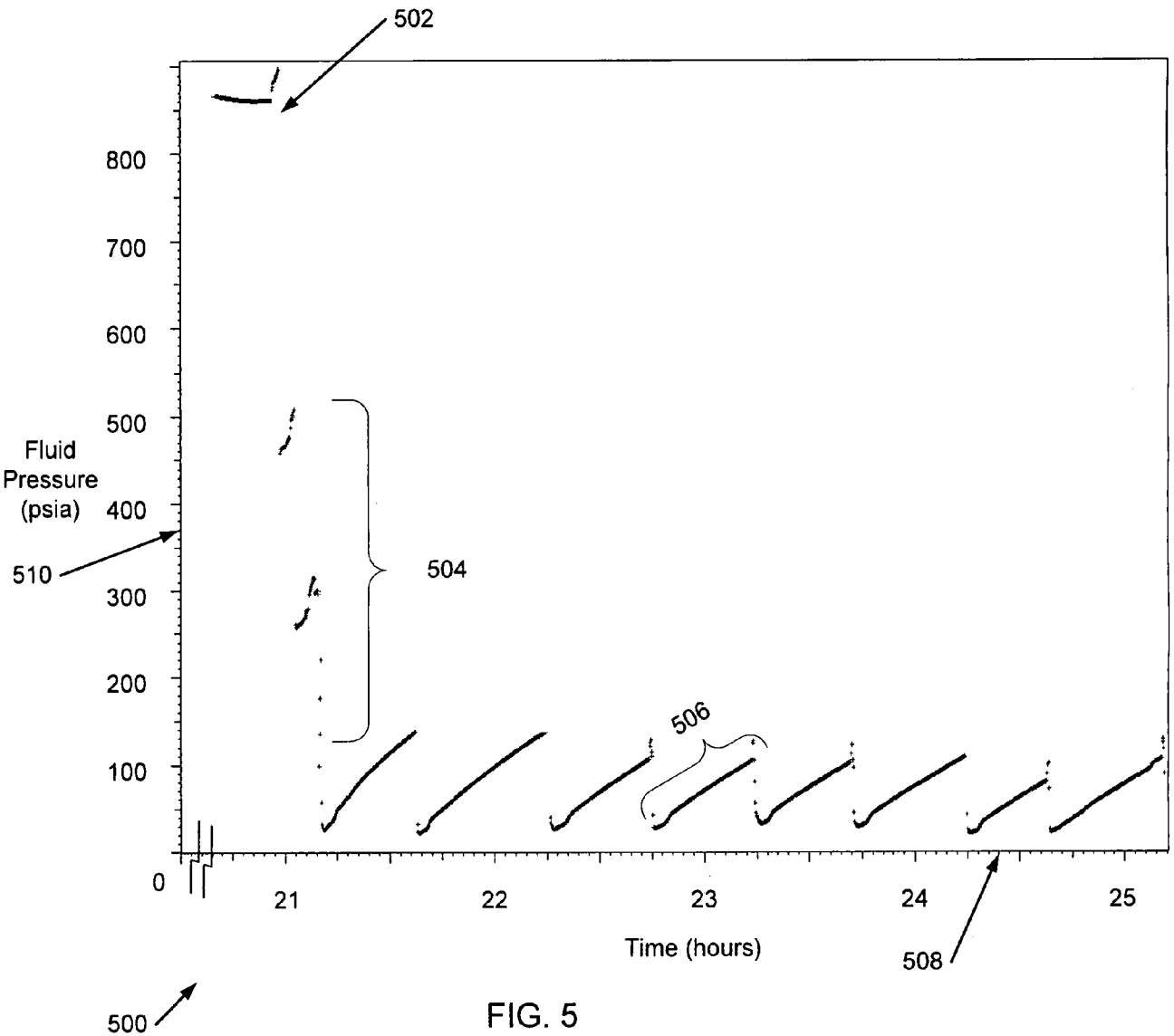
FIG. 5 depicts an example of a graph of pressure readings during a swabbing test in accordance with one or more embodiments of the invention.

FIG. 5 shows an example of a graph of pressure readings over time during a swabbing test in accordance with one or more embodiments of the invention. The following description of this FIG. 5 incorporates the references from FIG. 3. The graph shown in FIG. 5 is merely exemplary and is not intended to limit the scope of the invention.

Referring to FIG. 5, the graph (500) includes the following: (i) a series of pressure readings prior to the start of the swabbing test (502); (ii) a series of pressure readings during setup of the swabbing test (504); (iii) a series of pressure readings during the runs of the swabbing test (506); (iv) a horizontal axis (508); and (v) a vertical axis (510).

As shown in FIG. 5, the graph (500) has a horizontal axis (508) in terms of time in hours, as described by the label for the horizontal axis (508), with each increment of the horizontal axis (508) measuring one-twentieth of an hour. The graph (500) also has a vertical axis (510) in terms of units of pressure in absolute pressure per square inch (psia), as described by the label for the vertical axis (510), with each increment of the vertical axis (510) measuring ten psia.

Initially, before the swabbing tool (314) is lowered down the pipe to begin the first run of the swabbing test, the pressure readings (502) are high due in part to the amount of fluid residing in the pipe (310). In this example, the pressure read by the pressure gauge (316) during the time before the start of the swabbing test is between 850 psia and 890 psia. As the swabbing tool (314) is lowered toward the bottom part of the pipe (310), the fluid in the pipe (310) flows through the swabbing tool (314) and fills the space between the swabbing tool (314) and the surface (306). As more fluid fills the space between the swabbing tool (314) and the surface (306), less fluid occupies the space between the plug (324) and the bottom of the swabbing tool (314). This reduction in fluid reduces the pressure read by the pressure gauge (316), as is shown on the graph (500) for the data points corresponding to 504. In this example, the pressure read by the pressure gauge (316) during the time that the swabbing tool (314) is being lowered to the bottom portion of the pipe (310) is between 890 psia when the swabbing tool (314) is inserted into the pipe (310) at the surface (306) and 30 psia when the swabbing tool (314) arrives at the bottom portion of the pipe (310). In this example, the time it takes to insert the swabbing tool (314) into the pipe (310) and lower the swabbing tool (310) to the bottom portion of the pipe (310) is about fifteen minutes.

As the swabbing test begins a run, the swabbing tool (314) is lifted up the pipe toward the surface (306) inducing the fluid located below the swabbing tool (314) to follow the swabbing tool (314) up the pipe (310). As more fluid fills the pipe below the swabbing tool (314), the pressure read by the pressure gauge (316) increases, as is shown on the graph (500) for the data points at 506. In this example, the pressure read by the pressure gauge (316) during each run of the swabbing test is between about 25 psia at the start of the run and about 120 psia at the end of the run. The time it takes to perform a run of the swabbing test is about twenty-seven minutes. Times between runs of a swabbing test may vary. In FIG. 5, the typical time between runs of the swabbing test is about three minutes. The number of runs of a swabbing test may vary. In this example, there were eight runs of the swabbing test.

Figure 6:
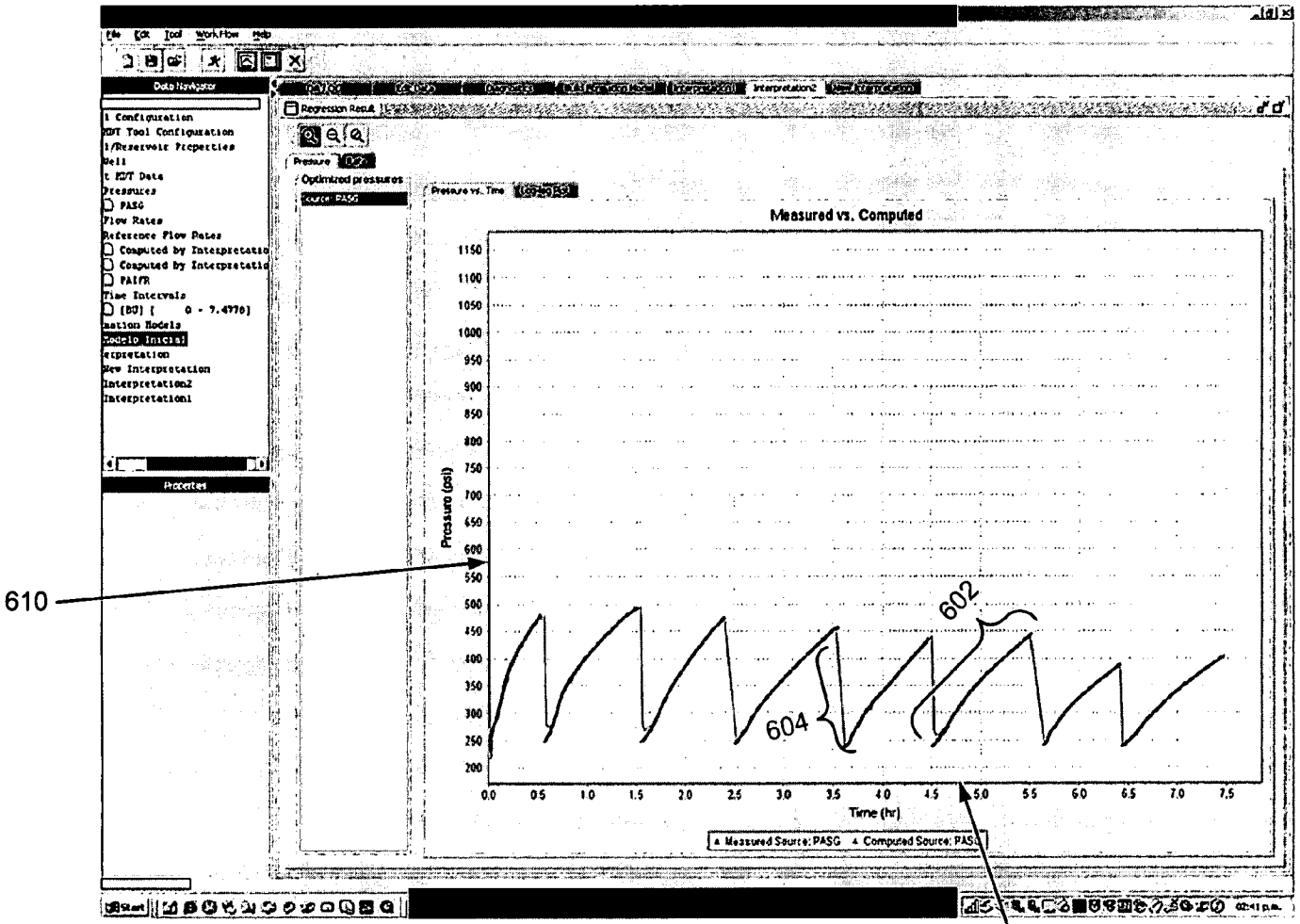
FIG. 6 depicts an example of pressure results from the regression analysis in accordance with one or more embodiments of the invention.

FIG. 6 depicts an example of pressure results from the regression analysis in accordance with one or more embodiments of the invention. The following description of this FIG. 6 incorporates the references from FIG. 3. The graph shown in FIG. 6 is merely exemplary and is not intended to limit the scope of the invention.

Referring to FIG. 6, the graph (600) includes the following: (i) a series of discrete pressure measurements (602); (ii) a continuous pressure output from the regression model (604); (iii) a horizontal axis (608); and (iv) a vertical axis (610). In this example, the nonlinear regression model was executed using a computer program, and the output of the nonlinear regression model is shown on a computer screen.

The graph (600) in FIG. 6 shows a series of discrete pressure measurements (602) taken over the course of a swabbing test. This series of discrete pressure measurements (602) were taken from the pressure gauge (316), located inside of, and toward the bottom portion of, the pipe (310). In this example, the pressure measurements (602) were taken over eight runs of the swabbing test, and the pressure ranged from about 240 psi and about 495 psi. The graph (600) also shows a continuous pressure output from the regression model (604). The continuous pressure output from the regression model (604) covers eight runs of the swabbing test, and the output correlates very closely with the series of discrete pressure measurements (602) during each run of the swabbing test.

The graph (600) has a horizontal axis (608) in terms of time in hours, as described by the label for the horizontal axis (608), with each increment along the horizontal axis (608) measuring a half hour. The graph (600) has a vertical axis (610) in terms of units of pressure in pounds per square inch (psi), as described by the label for the vertical axis (610), with each increment along the vertical axis (610) measuring fifty psi.

Figure 7:
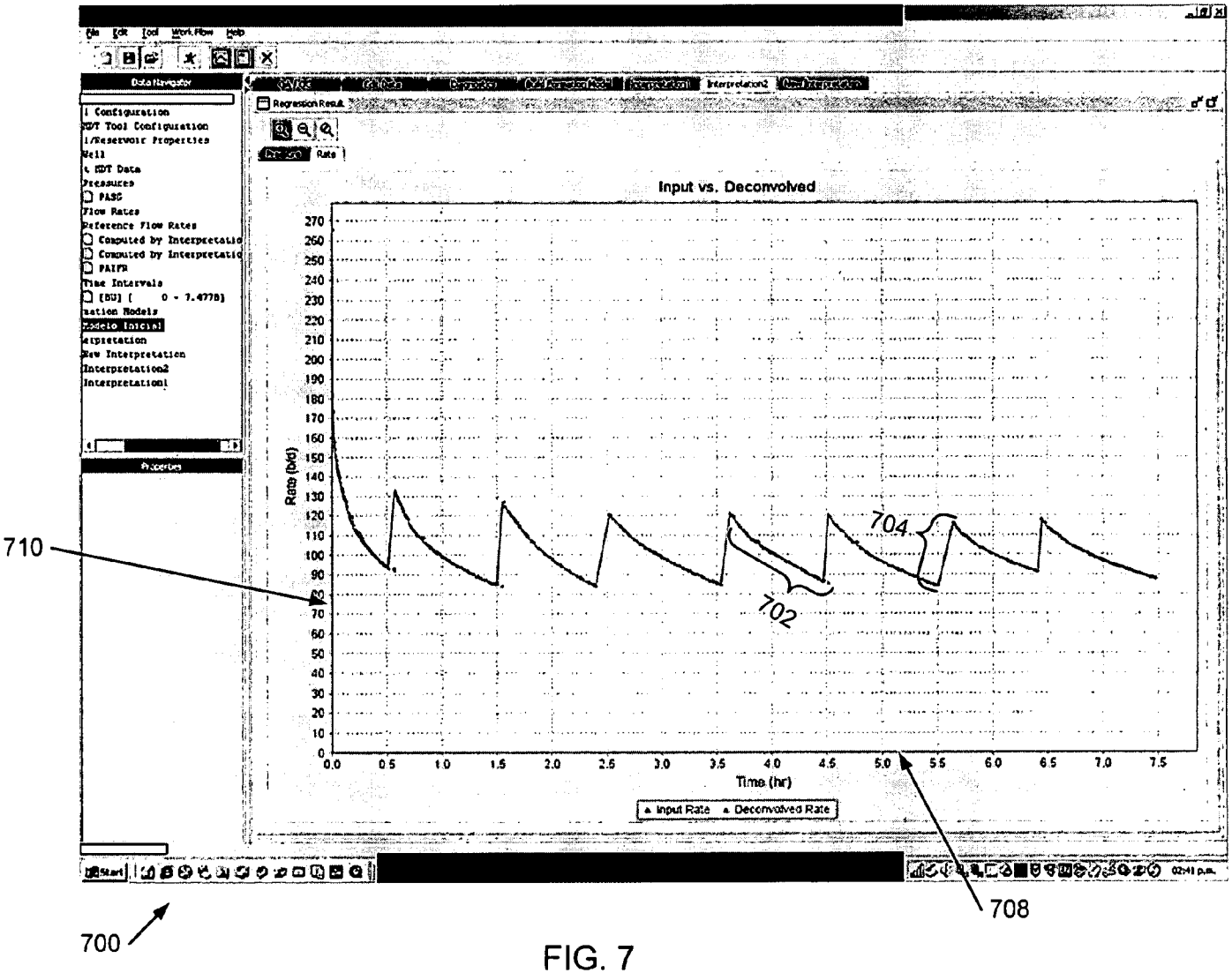
FIG. 7 depicts an example of flow rate results from the regression analysis in accordance with one or more embodiments of the invention.

FIG. 7 depicts an example of flow rate results from the regression analysis in accordance with one or more embodiments of the invention. The following description of this FIG. 7 incorporates the references from FIG. 3. The graph shown in FIG. 7 is merely exemplary and is not intended to limit the scope of the invention.

Referring to FIG. 7, the graph (700) includes the following: (i) a series of discrete flow rate calculations (702); (ii) a continuous flow rate output from the regression model (704); (iii) a horizontal axis (708); and (iv) a vertical axis (710). In this example, the nonlinear regression model was executed using a computer program, and the output of the execution is shown on a computer screen.

The graph (700) in FIG. 7 shows a series of discrete flow rate calculations (702) taken over the course of a swabbing test. This series of discrete flow rate calculations (702) were derived using pressure measurements taken from the pressure gauge (316), the volume of the pipe (310), and density of the fluid. In this example, the flow rate calculations (702) used data taken over eight runs of the swabbing test, and the flow rates ranged from about 92 barrels per day (b/d) and about 174 b/d for the first run of the swabbing test and from about 84 b/d and about 130 b/d for runs two through eight of the swabbing test. The graph (700) also shows a continuous flow rate output from the regression model (704). The continuous flow rate output from the regression model (704) covers eight runs of the swabbing test, and the output correlates very closely with the series of discrete flow rate calculations (702) during each run of the swabbing test.

The graph (700) has a horizontal axis (708) in terms of time in hours, as described by the label for the horizontal axis (708), with each increment along the horizontal axis (708) measuring a half hour. The graph (700) has a vertical axis (710) in terms of flow rate in barrels per day (b/d), as described by the label for the vertical axis (710), with each increment along the vertical axis (710) measuring ten b/d.

Figure 8:
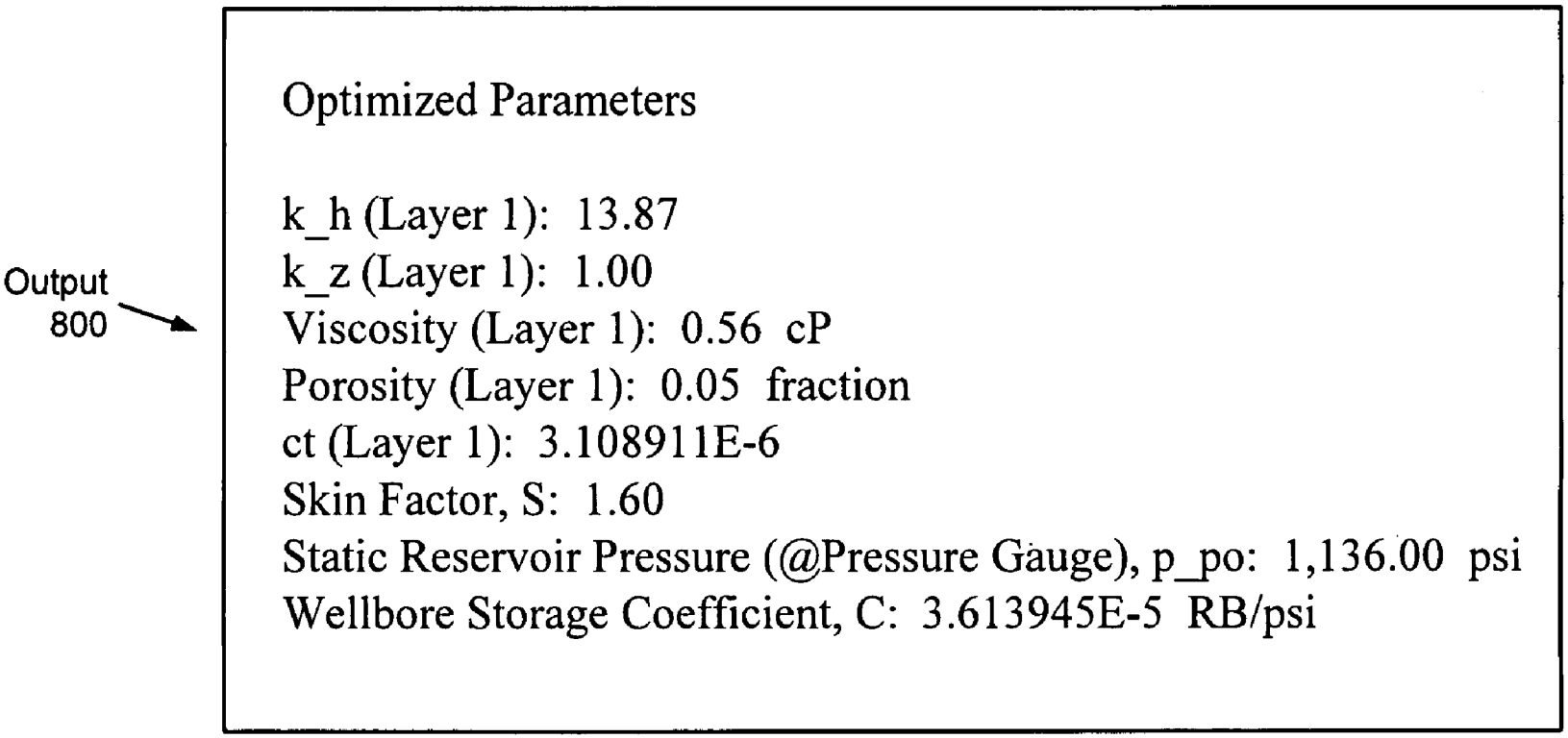
FIG. 8 depicts an example of the output from a regression analysis in accordance with one or more embodiments of the invention.

FIG. 8 depicts an example of the output from a regression analysis in accordance with one or more embodiments of the invention. The output (800) includes results for a number of variables, including but not limited to permeability of the reservoir (k_h) and skin (S). In this example, the results for a number of other variables is given, such as viscosity, porosity, static reservoir pressure at the pressure gauge, permeability at the surface (k_z), total compressibility (ct), and the wellbore storage coefficient.

In one or more embodiments of the invention, the invention provides a method and system for obtaining fluid flow rates in wells that do not exhibit uniform flow rates. Further, using the aforementioned flow rate information, the permeability of the reservoir may be determined. The permeability of the reservoir, in turn, may be used to generate a representative model of the reservoir. The model of the reservoir may be used to provide a production potential of the reservoir (e.g., the potential volume of hydrocarbons that may be produced from the well). Based on this information, additional operations to increase production may be performed. Example of such operations include, but are not limited to, drilling an additional wellbore, drilling a lateral in the wellbore, fracturing the formation, and installing and operating production equipment.

In one or more embodiments of the invention, the invention provides a method and system for determining flow rate from data obtained during the performance of a swabbing test, which may result in a decrease in cost and time used to obtain the information necessary to calculate the flow rates within the reservoir.

The invention (or portions thereof) may be implemented on virtually any type of computer regardless of the platform being used. For example, the computer system may include a processor, associated memory, a storage device, and numerous other elements and functionalities typical of today's computers (not shown). The computer may also include input means, such as a keyboard and a mouse, and output means, such as a monitor. The computer system may be connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system may be located at a remote location and connected to the other elements over a network. Further, the invention may be implemented on a distributed system having a plurality of nodes, where each portion of the invention may be located on a different node within the distributed system. In one or more embodiments of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, or any other computer readable storage device.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A method for increasing production in a reservoir, comprising:

performing a swabbing test at a depth in a pipe, wherein the pipe is located in a wellbore and wherein a portion of the wellbore is located inside the reservoir;

measuring, during a run of the swabbing test, a plurality of pressures in a bottom portion of the pipe using a pressure gauge to obtain a plurality of pressure measurements, wherein the pressure gauge is affixed to an inner wall of the bottom portion of the pipe; and determining a plurality of flow rates of fluid flowing from the reservoir through perforations in the wellbore into the pipe during the run of the swabbing test using a flow rate equation and the plurality of pressure measurements.

2. The method of claim 1 further comprising:

generating, after determining the plurality of flow rates of fluid, a model of the reservoir using the plurality of flow rates of fluid, wherein the model is used to determine a production potential of the reservoir.

3. The method of claim 2, wherein generating the model of the reservoir comprises:

determining a permeability of the reservoir using a nonlinear regression model and the plurality of flow rates.

4. The method of claim 3, further comprising:

determining, after generating the model, an operation to perform, using the permeability, to increase the production of hydrocarbons in the reservoir, wherein the operation comprises at least one from a group consisting of drilling an additional wellbore, drilling a lateral in the wellbore, fracturing the formation, and installing and operating production equipment; and performing the operation.

5. The method of claim 1, wherein the flow rate equation comprises:

$$Q(i)=[kh(P_i-P_{(i)})]/\{162.6B_o\mu[\log(kt/\Phi\mu c_t r_w^2)-3.23+0.868s]\}$$

wherein Q(i) is the instantaneous flow rate at time i, k is the permeability, measured in millidarcy (md), h is the thickness of the reservoir, measured in feet (ft), $P_i$ is the initial pressure, $P_{(i)}$ is the instantaneous pressure at time $t_i$, $B_o$ is the formation volume factor (a unitless number), μ is the viscosity, measured in centipoise (cP), t is the time, measured in hours, Φ is porosity in terms of a unitless fraction, $c_t$ is the total compressibility, measured in terms of inverse pounds per square inch ($psi^{-1}$), $r_w$ is the radius of the pipe, measured in feet (ft), and s is the skin, a unitless number.

6. The method of claim 1, wherein the plurality of pressure measurements is taken continuously.

7. The method of claim 1, wherein the plurality of flow rates is determined after the swabbing test concludes.

8. The method of claim 1, wherein the swabbing test is one of a plurality of swabbing tests and the depth in the wellbore is one of a plurality of depths in the wellbore.

9. A system comprising:

a pipe located in a wellbore below a surface and having a portion located in a reservoir;

a swabbing tool moveably located inside the pipe and configured to perform a swabbing test at a depth in the pipe as the swabbing tool is pulled toward the surface;

a pressure gauge affixed to an inner wall of a bottom portion of the pipe, at a location further from the surface than the swabbing tool, wherein the pressure gauge is configured to measure, during a run of the swabbing test, a plurality of pressures in the bottom portion of the pipe to obtain a plurality of pressure measurements; and a computer comprising software instructions executing on a computer processor, wherein the software instructions are configured to:

determine a plurality of flow rates of fluid flowing from the reservoir through perforations in the wellbore into the pipe during the run of the swabbing test using a flow rate equation and the plurality of pressure measurements; and generate a model of the reservoir using the plurality of flow rates of fluid, wherein the model is used to determine a production potential of the reservoir.

10. The system of claim 9, wherein the software instructions are further configured to:

determine, before generating the model of the reservoir, a permeability of the reservoir using a nonlinear regression model and the plurality of flow rates.

11. The system of claim 10, wherein the software instructions are further configured to:

determine, after generating the model of the reservoir, an operation to perform, using the permeability, to increase the production of hydrocarbons in the reservoir, wherein the operation comprises at least one from a group consisting of drilling an additional wellbore, drilling a lateral in the wellbore, fracturing the formation, and installing and operating production equipment.

12. The system of claim 9, wherein the flow rate equation comprises:

$$Q(i)=[kh(P_i-P_{(i)})]/\{162.6B_o\mu[\log(kt/\Phi\mu c_t r_w^2)-3.23+0.868s]\}$$

wherein Q(i) is the instantaneous flow rate at time i, k is the permeability, measured in millidarcy (md), h is the thickness of the reservoir, measured in feet (ft), $P_i$ is the initial pressure, $P_{(i)}$ is the instantaneous pressure at time $t_i$, $B_o$ is the formation volume factor (a unitless number), μ is the viscosity, measured in centipoise (cP), t is the time, measured in hours, Φ is porosity in terms of a unitless fraction, $c_t$ is the total compressibility, measured in terms of inverse pounds per square inch ($psi^{-1}$), $r_w$ is the radius of the pipe, measured in feet (ft), and s is the skin, a unitless number.

13. The system of claim 9, wherein the plurality of pressure measurements is taken continuously.

14. The system of claim 9, wherein the plurality of flow rates is determined after the swabbing test concludes.

15. The system of claim 9, wherein the swabbing test is one of a plurality of swabbing tests and the depth in the wellbore is one of a plurality of depths in the wellbore.

16. A system comprising:

a pipe located in a wellbore below a surface and having a portion located in a reservoir;

a swabbing tool moveably located inside the pipe and configured to perform a swabbing test at a depth in the pipe as the swabbing tool is pulled toward the surface;

a pressure gauge affixed to an inner wall of a bottom portion of the pipe, at a location further from the surface than the swabbing tool, wherein the pressure gauge is configured to measure, during a run of the swabbing test, a plurality of pressures in the bottom portion of the pipe to obtain a plurality of pressure measurements; and a computer comprising software instructions executing on a computer processor, wherein the software instructions are configured to:

determine a plurality of flow rates of fluid flowing from the reservoir through perforations in the wellbore into the pipe during the run of the swabbing test using a flow rate equation and the plurality of pressure measurements;

determine a permeability of the reservoir using a non-linear regression model and the plurality of flow rates; and determine an operation to perform, using the permeability, to increase the production of hydrocarbons in the reservoir, wherein the operation comprises at least one from a group consisting of drilling an additional wellbore, drilling a lateral in the wellbore, fracturing the formation, and installing and operating production equipment.

17. The system of claim 16, wherein the flow rate equation comprises:

$$Q(i)=[kh(P_i-P_{(i)})]/\{162.6B_o\mu[\log(kt/\Phi\mu c_t r_w^2)-3.23+0.868s]\}$$

wherein Q(i) is the instantaneous flow rate at time i, k is the permeability, measured in millidarcy (md), h is the thickness of the reservoir, measured in feet (ft), $P_i$ is the initial pressure, $P_{(i)}$ is the instantaneous pressure at time $t_i$, $B_o$ is the formation volume factor (a unitless number), μ is the viscosity, measured in centipoise (cP), t is the time, measured in hours, Φ is porosity in terms of a unitless fraction, $c_t$ is the total compressibility, measured in terms of inverse pounds per square inch ($psi^{-1}$), $r_w$ is the radius of the pipe, measured in feet (ft), and s is the skin, a unitless number.

18. The system of claim 16, wherein the plurality of pressure measurements is taken continuously.

19. The system of claim 16, wherein the plurality of flow rates are calculated after the swabbing test concludes.

20. The system of claim 16, wherein the swabbing test is one of a plurality of swabbing tests and the depth in the wellbore is one of a plurality of depths in the wellbore.

* * * * *